United States Patent [19]

Shichman

[11] 4,407,432

[45] Oct. 4, 1983

[54] PRESSURE RELIEF SYSTEM FOR PRESSURIZED GAS CONTAINERS

[75] Inventor: Daniel Shichman, Trumbull, Conn.

[73] Assignee: United States Surgical Corporation, Norwalk, Conn.

[21] Appl. No.: 218,549

[22] Filed: Dec. 22, 1980

[51] Int. Cl.[3] ..... B65D 83/00

[52] U.S. Cl. ..... 222/54; 137/74; 137/588; 222/397

[58] Field of Search ..... 222/54, 61, 396, 397, 222/481, 488, 1; 169/29, 75; 236/101 E, 93 A; 239/124, 126; 137/72, 74, 588

[56] References Cited

U.S. PATENT DOCUMENTS

| | | | |
|---|---|---|---|
| 1,211,173 | 1/1917 | King | 137/72 |
| 2,225,220 | 12/1940 | Huff | 220/89 |
| 2,244,302 | 6/1941 | Lynn et al. | 222/54 |
| 2,336,490 | 12/1943 | Lo Vico | 220/89 |
| 2,368,281 | 1/1945 | Wittenberg | 137/72 |
| 2,440,462 | 4/1948 | Cooper | 220/85 |
| 2,975,983 | 3/1961 | Niebling | 239/126 |
| 3,145,874 | 8/1964 | Webb | 220/89 |
| 3,155,271 | 11/1964 | Summers et al. | 220/89 |
| 3,241,713 | 3/1966 | Clapp et al. | 222/5 |
| 3,245,578 | 4/1966 | Sutton | 222/397 |
| 3,294,277 | 12/1966 | Wood | 220/89 |
| 3,515,309 | 6/1970 | Welch | 220/89 |
| 3,680,743 | 8/1972 | Reinnagel | 222/397 |
| 3,685,686 | 8/1972 | Raidl | 220/89 A |
| 3,768,696 | 10/1973 | Laerdal | 222/397 |
| 3,784,064 | 1/1974 | Hardt | 222/397 |
| 3,827,449 | 8/1974 | Gurizzan et al. | 137/68 |
| 3,872,874 | 3/1975 | Nedelec et al. | 137/68 |
| 4,119,236 | 10/1978 | Shaw et al. | 220/89 A |
| 4,147,272 | 4/1979 | Stenner et al. | 222/397 |
| 4,158,422 | 6/1979 | Witten et al. | 220/89 A |
| 4,175,678 | 11/1979 | Fukuda | 222/54 |

*Primary Examiner*—H. Grant Skaggs

*Attorney, Agent, or Firm*—Stephen P. Gilbert

[57] ABSTRACT

Apparatus for venting a pressurized gas container is disclosed. The container bottom moves outward as a result of over-pressure caused by excessive temperature. The bottom pushes against a member of the housing, thereby forcing the nozzle head to hit and become fixed against a second member of the housing. Continued movement of the container body toward the nozzle head effectively depresses the nozzle head, thus releasing gas from the container. In a preferred embodiment, a safety plug in a passageway in the nozzle head is melted to provide a channel for the vented gas.

6 Claims, 4 Drawing Figures

PRESSURE RELIEF SYSTEM FOR PRESSURIZED GAS CONTAINERS

BACKGROUND OF THE INVENTION

Gas-powered devices are well-known. Some require an external gas supply, e.g., pneumatic jackhammers. Others carry their own gas supplies, usually in the form of a pressurized gas container. See, e.g., U.S. Pat. Ser. No. 152,758 filed May 23, 1980 and now U.S. Pat. No. 4,331,277 by David T. Green for Self-Contained Gas Powered Surgical Stapler and assigned to U.S. Surgical Corporation.

The danger of explosion of pressurized gas containers exists whenever they are heated, accidentally or on purpose. For example, disposal of devices having pressurized gas containers (e.g., toys, hand tools) poses a problem because a common method of disposal is incineration, where the temperatures may reach 500° C. or more. Although containers could be constructed to withstand the resulting extreme pressures, the substantial increase in their cost makes that solution unattractive. In the case of gas-powered medical devices, which may be sterilized in an ethylene oxide atmosphere at temperatures of up to 60° to 65° C., pressurized gas containers in such devices which are so sterilized must be stable at those temperatures and yet relieve any over-pressure conditions caused by higher temperatures. Accordingly, a low-cost reliable way of relieving over-pressure conditions in this type of container is needed.

SUMMARY OF THE INVENTION

A new configuration for relieving over-pressure conditions caused by excessive temperatures in pressurized gas containers has now been developed. Broadly, this invention comprises:

(a) a housing having top and bottom members; and (b) a pressurized gas container having a bottom and a gas discharge element and located in the housing with the container bottom near the housing bottom member and the gas discharge element near the housing top member; the container bottom constructed so as to expand outward when the gas temperature exceeds a predetermined value and the housing and container arranged so that the expanding bottom pushes against the housing bottom and forces the container to move towards the top member so that the gas discharge element pushes against the top member and is depressed thereby sufficiently to vent gas from the container.

A preferred embodiment of the present invention is an over-pressure safety venting system for a pressurized gas container wherein depressing the gas discharge element located on top of the container allows gas to leave the container through a first passageway in the discharge element, said container located in a housing; said safety venting system comprising:

(a) a second passageway in the gas discharge element through which gas passes when the gas discharge element is depressed and the passageway is not obstructed;

(b) a safety plug of material having a predetermined melting point obstructing the second passageway when the plug is in a an unmelted state;

(c) a bottom on the gas container that expands outward when the gas temperature is approximately equal to the melting point of the safety plug;

(d) a top member in the housing located close to the gas discharge element; and (e) a bottom member in the housing against which the bottom of the container pushes when the container bottom expands outward, thereby causing the rest of the container to move toward the top member;

the top and bottom members being close enough to each other so that movement of the rest of the container toward the top member brings the gas discharge element into contact with the top member and forces the gas discharge member to be depressed, thereby venting the container through the second passageway.

This invention provides a configuration that safely relieves over-pressure conditions in devices using pressurized gas containers without regard to whether those devices are in use, in storage, or are being shipped.

BRIEF DESCRIPTION OF THE DRAWINGS

To facilitate further description of the invention, the following drawings are provided in which.

Figure 1:
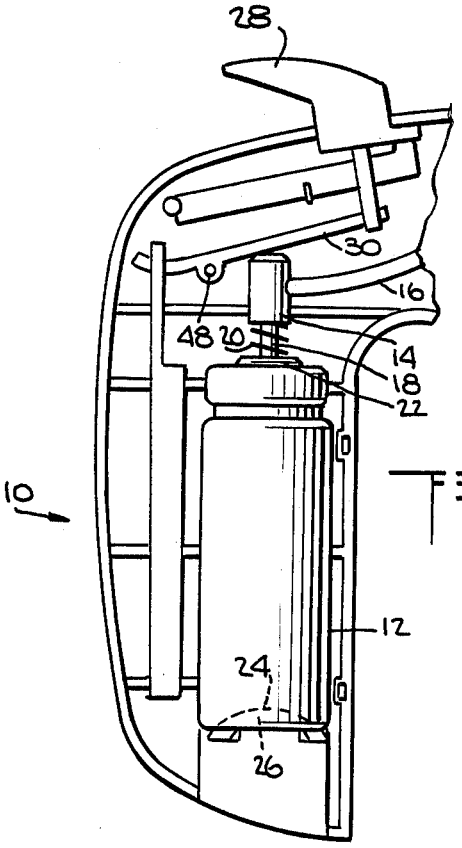
FIG. 1 is a sectional view of a pressurized gas container in a gas-powered device.

It should be understood that the drawings are for illustrative purposes only and should not be construed to limit the scope of the invention.

DETAILED DESCRIPTION OF THE INVENTION

In a preferred embodiment, a passageway in the gas discharge element (e.g., push-button nozzle) of the pressurized container is filled with a material having the desired melting point and the container bottom is fabricated so as to move outward significantly when the internal pressure rises above a predetermined value in response to an increase in temperature. The temperature causing such outward movement of the container bottom should be approximately the same as the melting point of the material obstructing the passageway.

The geometry of the housing is such that the following occurs. The outward movement of the container bottom bears against a bottom member in the housing and forces the rest of the container to move away from that housing member. The container movement forces the nozzle against a top housing member and continued movement of the container towards the stationary nozzle causes release of the gas. In the meantime, the safety plug material has melted or softened sufficiently for the gas to force the plug out and the gas is vented through the formerly obstructed passageway.

The container may have any dimensions and be of any material so long as it can perform in the required manner. A typical container is approximately 2½ inches (63 millimeters) long and ⅞ inches (22 millimeters) in diameter and is made of aluminum 19 thousandths of an inch (0.48 millimeters) thick. A typical nozzle measures approximately ⅓ inch (8 millimeters) in diameter by ½ inch (13 millimeters) long with a tapered safety gas passageway 1/20 inch (1.2 millimeters) in diameter at the surface of the nozzle and having a taper of 8 degrees on each side.

The gas may be any gas used in such environments (e.g., halogenated hydrocarbons) and the internal pressure in the containers will typically range from 60 to 175 psia (413 to 1205 kPa). The pressure that causes the container bottom to move outward will generally be 200% more than the normal operating pressure. Fabricating containers to bulge at selected locations due to over-pressure conditions is well within the skill of the art. See, e.g., U.S. Pat. No. 3,680,743.

The safety plug material may be any substance capable of holding a shape without exhibiting significant cold flow or creep or fracturing under normal operating conditions. The plug material should be inert with respect to the gas and the gas nozzle material. Typical melting points of the plug materials suitable for use herein will range from approximately 50° to 85° C. or higher. For disposable surgical devices, which may be sterilized in ethylene oxide atmospheres at temperatures of up to 60° to 65° C., melting points of from approximately 65° to 85° C. are preferred. Typical materials are waxes and synthetic thermoplastics, of which waxes are preferred.

Waxes suitable for use herein include "Duron Petroleum Micro Wax 170/180," a microcrystalline wax melting at 170° to 180° F. (76° to 82° C.), with a viscosity of 75 SUS at 210° F. (99° C.), "Loobwax 0597," a paraffinic wax of a type known to the industry as "165 Wax," melting at 71° C., with a viscosity of 7 cs at 100° C., and "Duron Pure Ozokerite 71/74," a wax with pronounced iso-paraffinic properties, melting at 73° to 74° C., of which the last is preferred. These are marketed by Dura Commodities Corporation of New York. Other suitable waxes include Candelilla wax (mp of 67° to 69° C.) and Cotton wax (mp of 68° to 71° C.).

When Freon-500 (trademark of E.I. du Pont de Nemours and Company) is the propellant, the normal operating pressure in the container is approximately 103 psia (709 kPa) at 70° F. (21° C.), "Duron Pure Ozokerite 71/74" (above) is the preferred plug material, and the container is constructed so that its bottom moves outward at approximately 168° F. (75.5° C.).

Turning to the drawings, FIG. 1 shows gas-powered device housing 10. Pressurized gas container 12 is located in the housing so that its concave bottom 24 rests on convex housing bottom member 26 and gas discharge element (or nozzle head) 14 contacts top housing member (or arm) 30. The gas-powered device is activated by pushing down on button 28. That rotates arm 30 around pin 48, moving nozzle head 14 towards top 22 of container 12.

Nozzle head 14 is connected to stem 18. Inside container 12 is a valve (not shown). Pushing nozzle head 14 down pushes stem 18 down, thereby opening the valve to allow gas to leave and pass through tube 16 to other portions of the device not shown. Spring 20 biases nozzle head 14 away from top 22 and against arm 30.

Figure 2:
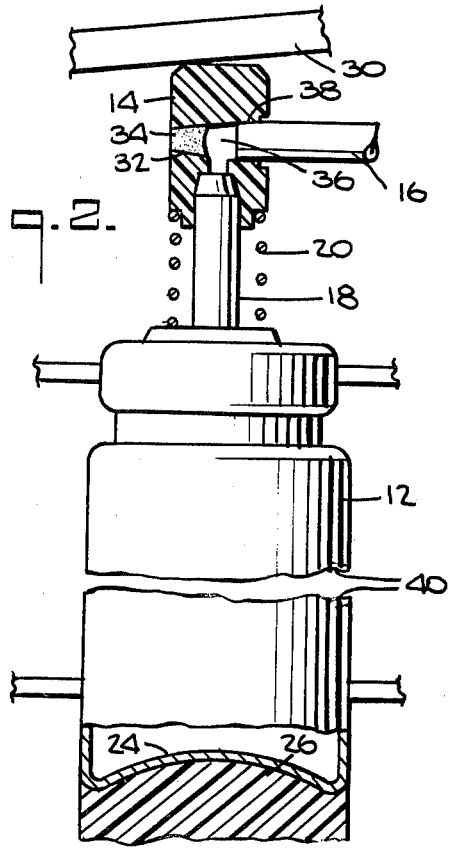
FIG. 2 is an enlarged sectional view of the container in the device.

FIG. 2 is an enlarged detail view, with break lines 40 indicating omission of a portion of container 12. Spring 20 is shown in cross-section, as are concave bottom 24 and nozzle head 14. Stem 18 contains a bore (not shown), through which gas flows when the nozzle and stem are sufficiently depressed. The gas passes up into plenum 36 and out through tube 16, whose end is located in passageway 38 of nozzle head 14. Gas would also flow out through passageway 32, which communicates with plenum 36, were passageway 32 not obstructed by safety plug 34.

Figure 3:
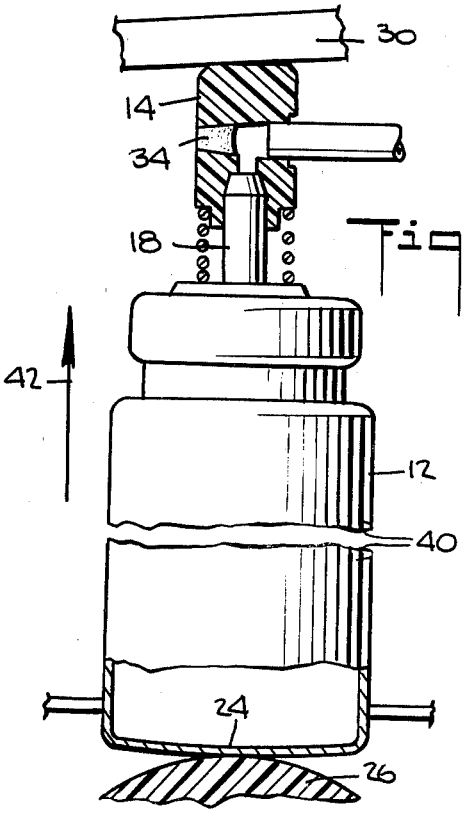
FIG. 3 shows the container moving up in response to an over-pressure condition inside the container, caused by excessive temperature.

In FIG. 3, an over-pressure condition due to excessive temperature is present. Container bottom 24 has moved outward and pushed against housing bottom 26, causing the rest of the container to move toward top housing member 30, as shown by arrow 42. That, in turn, has forced nozzle head 14 against member 30 and then moved the container toward nozzle head 14 and stem 18, in effect depressing the nozzle head and stem. In this view, the resulting gas flow has just started, thus softened/melted safety plug 34 has not yet been forced out of the nozzle head.

Figure 4:
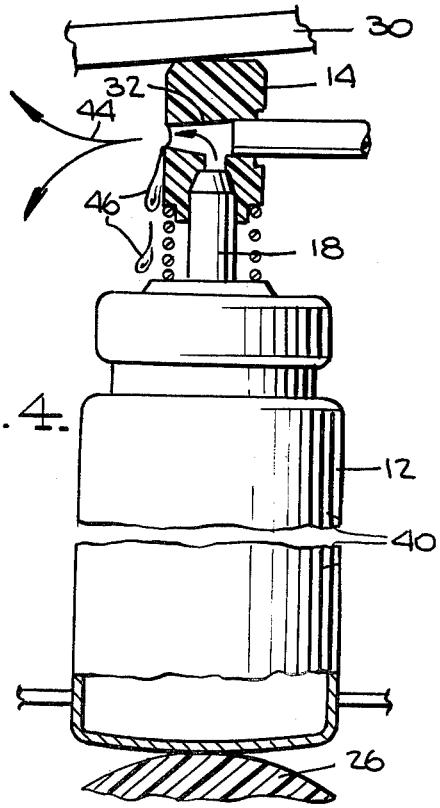
FIG. 4 shows gas pushing the melted safety plug material out of the nozzle head on the container and being vented therefrom, thus relieving the over-pressure condition and preventing explosion.

In FIG. 4 the flow of gas (indicated by arrows 44) has just blown melted plug 34 out of its passageway in the form of liquid drops 46, thereby relieving the over-pressure condition and preventing explosion of container 12. Passageway 32 is tapered, with the narrowest portion at the outer surface of the nozzle head, to prevent solid plug 34 from being blown from the passageway during normal operation.

Variations and modifications will be obvious to those skilled in the art, and the claims are intended to cover all such variations and modifications as fall within the true spirit and scope of the invention. For example, bottom housing member 26, against which the container bottom pushes due to excessive temperature, need not be a convex surface mating with the container bottom but could be an adjustable screw.

I claim:

1. A low-cost over-pressure safety venting system for a pressurized gas container in a disposable gas-powered medical device wherein depressing the gas discharge element located on top of the container during normal operation allows gas to leave the container through a first passageway in the discharge element and pass to the other portions of the device to power the device, said container located in a housing; said safety venting system comprising:

(a) a second passageway in the gas discharge element through which gas passes when the gas discharge element is depressed and the passageway is not obstructed, said first and second passageways being fluidly connected;

(b) a safety plug of material having a predetermined melting point obstructing the second passageway when the plug is in an unmelted state;

(c) a bottom on the gas container that expands outward when the gas temperature is approximately equal to the melting point of the safety plug;

(d) a top member in the housing located close to the gas discharge element; and (e) a bottom member in the housing against which the bottom of the container pushes when the container bottom expands outward, thereby causing the rest of the container to move toward the top member;

the top and bottom members being close enough to each other so that movement of the rest of the container toward the top member brings the gas discharge element into contact with the top member and forces the gas discharge member to be depressed, thereby venting the container and the other portions of the device containing pressurized gas through the second passageway.

2. The safety venting system of claim 1 wherein the safety plug is of wax having a melting point of from approximately 50° to 85° C.

3. The safety venting system of claim 1 employed in a disposable medical device, wherein the safety plug is of wax and has a melting point of from approximately 65° to 85° C.

4. A method for preventing explosion during incineration of a disposable gas-powered medical device containing a pressurized gas container wherein depressing the gas discharge element located on top of the container during normal operation allows gas to leave the container through a first passageway in the discharge element and pass to the other portions of the device to power the device, the container being located in a housing; said method comprising providing:

(a) a second passageway in the gas discharge element through which gas passes when the gas discharge element is depressed and the passageway is not obstructed, said first and second passageways being fluidly connected;

(b) a safety plug of material having a predetermined melting point obstructing the second passageway when the plug is in an unmelted state;

(c) a bottom on the gas container that expands outward when the gas temperature is approximately equal to the melting point of the safety plug;

(d) a top member in the housing located close to the gas discharge element; and (e) a bottom member in the housing against which the bottom of the container pushes when the container bottom expands outward, thereby causing the rest of the container to move toward the top member;

the top and bottom members being close enough to each other so that movement of the rest of the container toward the top member brings the gas discharge element into contact with the top member and forces the gas discharge member to be depressed, thereby venting the container and the other portions of the device containing pressurized gas.

5. The method of claim 4 wherein the safety plug is of wax having a melting point of from approximately 50° to 85° C.

6. The method of claim 4 wherein the safety plug is of wax and has a melting point of from approximately 65° to 85° C.

* * * * *